US007810942B2

(12) United States Patent
Kunkel et al.

(10) Patent No.: US 7,810,942 B2
(45) Date of Patent: Oct. 12, 2010

(54) SANITARY FITTING COMPRISING AN ASSEMBLY OF SEVERAL LIGHT SOURCES

(75) Inventors: Horst Kunkel, Stuttgart (DE); Gunter Veigel, Leonberg (DE)

(73) Assignee: Hansa Metallwerke AG, Stuttgart (DE)

( * ) Notice: Subject to any disclaimer, the term of this patent is extended or adjusted under 35 U.S.C. 154(b) by 263 days.

(21) Appl. No.: 11/813,159

(22) PCT Filed: Dec. 22, 2005

(86) PCT No.: PCT/EP2005/013845

§ 371 (c)(1),
(2), (4) Date: Dec. 20, 2007

(87) PCT Pub. No.: WO2006/072397

PCT Pub. Date: Jul. 13, 2006

(65) Prior Publication Data

US 2008/0205034 A1 Aug. 28, 2008

(30) Foreign Application Priority Data

Jan. 5, 2005 (DE) ..... 10 2005 001 305

(51) Int. Cl.
*F21V 21/00* (2006.01)

(52) U.S. Cl. ..... 362/96; 362/101; 362/231

(58) Field of Classification Search ..... 362/96, 362/101, 234, 249.01, 249.02, 231, 268, 362/237, 240, 244, 246; 239/18, 20, 289
See application file for complete search history.

(56) References Cited

U.S. PATENT DOCUMENTS

| | | | | |
|---|---|---|---|---|
| 4,749,126 | A | 6/1988 | Kessener et al. | |
| 6,126,290 | A * | 10/2000 | Veigel | 362/96 |
| 6,623,511 | B1 * | 9/2003 | Daffer et al. | 607/82 |
| 7,008,073 | B2 * | 3/2006 | Stuhlmacher, II | 362/96 |
| 7,162,752 | B2 * | 1/2007 | McDonald et al. | 4/507 |
| 7,293,300 | B2 * | 11/2007 | Kunkel | 4/507 |

FOREIGN PATENT DOCUMENTS

| | | |
|---|---|---|
| DE | 196 54 359 C1 | 8/1998 |
| DE | 199 54 180 A1 | 6/2001 |
| DE | 201 02 857 U1 | 7/2001 |
| DE | 203 04 520 U1 | 8/2003 |
| DE | 203 17 375 U1 | 4/2004 |
| WO | WO 95 29300 | 11/1995 |
| WO | 03065861 A2 | 8/2003 |

* cited by examiner

*Primary Examiner*—Thomas M Sember
(74) *Attorney, Agent, or Firm*—Factor & Lake, Ltd.

(57) ABSTRACT

The invention relates to a sanitary fitting containing an assembly of several light sources for illuminating water that flows out of or into the sanitary fitting, said light sources generating light of different colors. According to the invention, collecting optics are positioned upstream of the light sources to focus and mix the light that is generated by the light sources. This permits the generation of intensive mixed colors, which, for example, can illuminate the interior of a shower jet.

27 Claims, 3 Drawing Sheets

SANITARY FITTING COMPRISING AN ASSEMBLY OF SEVERAL LIGHT SOURCES

RELATED APPLICATIONS

This application claims the filing benefit of PCT Patent Application No. PCT/EP2005/013845, filed Dec. 22, 2005; which claims the benefit of German Patent Application No. 10 2005 001 305.8, filed Jan. 5, 2005; the contents of these applications all are incorporated herein by reference.

TECHNICAL FIELD

The present invention relates to a sanitary fitting comprising an assembly of several light sources for illuminating water that flows out of or into the sanitary fitting, wherein light of different colours can be generated by the said light sources.

BACKGROUND OF THE INVENTION

Such a sanitary fitting is known from DE 203 17 375 U1. The sanitary fitting described there comprises in the region of the water outlet or water inlet illumination means with which light of different colours can be generated. In this case the colour is adjusted depending on the temperature of the water. In an embodiment described in more detail therein the illumination means comprise three LEDs, which are directly arranged between outlet openings of the sanitary fitting.

SUMMARY OF THE INVENTION

The object of the invention is to modify such sanitary fitting so that the light effect generated by the light sources is able to transmit not only information, but can also stimulate emotions that are regarded as pleasant by the user of the sanitary fitting.

According to one embodiment of the invention, this object may be achieved in a sanitary fitting of the type mentioned in the introduction of a collecting optics for focusing and mixing the light generated by the light sources, the optics being arranged in front of the light sources.

The inventors have recognised that currently used light sources, such as for example low-voltage halogen lamps as well as LEDs, which are particularly advantageous on account of their compactness, radiate the light over a relatively large spatial angular region. This makes it difficult on the one hand to mix over a relatively large spatial region the coloured light generated by the light sources and in this way to generate a mixed colour that is perceived as pleasant.

Secondly, so much light is radiated laterally by known light sources that basically only a region in the immediate vicinity of the inlet or outlet of the sanitary fitting is illuminated. If the light generated by the light sources is on the other hand focussed and mixed according to the invention by means of a collecting optics, then a water jet issuing from the sanitary fitting can be illuminated over a longer path—preferably from the inside to the outside—with a relatively more uniform colour, which results in an aesthetically very pleasing light effect.

Preferably the collecting optics comprises several optical elements having a collecting action, exactly one or also several of the optical elements being associated with each light source. In this way the light generated by the light sources can be detected and focussed very much more easily than would be the case with a single optical element, which detects collectively all light beams generated by the light sources.

In principle it is possible to arrange the light sources in an inclined manner so that their radiation axes, with respect to which the light beams generated by the light sources are at least substantially rotationally symmetrical, meet at a point. In this way a good intermixing of the light would be ensured for the region surrounding this point. An inclined arrangement of the light sources is however structurally relatively complicated and therefore expensive.

For this reason preferably at least one light source is arranged relative to the optical element associated with it, so that the radiation axis of the at least one light source runs parallel and in a staggered manner to the axis of symmetry of the associated optical element. This staggering may for example amount to more than 10% or even more than 15% of the radius of the respective optical element.

A tilting of the light beam generated by the at least one light source is produced by such a parallel staggering of the radiation axes of the light sources relative to the symmetry axes of the associated optical elements. Due to the relative position of the radiation axis of the at least one light source relative to the symmetry axis of the associated optical element, the alignment and the degree of tilting can thereby be adjusted practically as desired. This opens up the possibility, simply through this tilting action, of aligning the light beams generated by the light sources onto a point lying outside the sanitary fitting, in the vicinity of which the light beams mix practically completely. In this way a complicated tilting arrangement of the light sources can be dispensed with.

Since the light sources on the one hand are spaced relatively close to one another and the aforementioned point may be located relatively far, for example about 50 cm, from the sanitary fitting, a very good intermixing of the light beams generated by the light sources is also achieved at relatively large distances from the said point. In this way the user of the sanitary fitting perceives a largely homogenous colour effect over the typically necessary length, which is determined by the distance between the sanitary fitting and an object, for example a washstand or a shower basin.

The light sources are preferably arranged distributed in a multiply symmetrical manner around a common axis of symmetry. With three light sources these may be arranged for example at the corners of an equilateral triangle, and in the case of four light sources may be arranged at the corners of a square.

The optical elements which are associated with the individual light sources preferably act as an aspherical lens. This applies in particular if the radiation axes are arranged staggered relative to the symmetry axes of the optical elements.

The optical elements with a collecting action may for example be diffractive optical elements or conventional lens elements. In the last-mentioned case it has proved convenient if the lens elements have in each case a concave entry surface and a convex exit surface. In the case of an aspherical design of the lens elements, these preferably have a curvature that is smallest at the axis of symmetry of the elements.

The individual lens elements may in this connection also form a one-piece unit. This is particularly advantageous if the light sources are also arranged in a narrow space, as is often the case in the spatially cramped conditions in sanitary fittings. The lens elements may in this case adjoin one another along the common axis of symmetry of the light sources. Due to the immediate closeness of the lens elements, it can be ensured with such an arrangement that portions of a light beam generated by a light source that do not pass through the optical element associated with the light source per se, are detected and focussed at least by optical elements that are associated with other light sources.

In an advantageous modification the collecting optics also comprises an optical collecting element having a collecting effect, which jointly collects the light beams leaving the optical elements. The collecting element is in this connection preferably designed so that the light generated by the light sources leaves the sanitary fitting substantially as: a largely parallel or at least only slightly diverging or converging light beam.

The optical collecting element preferably has an axis of symmetry that runs along the common axis of symmetry of the light sources. An aspherical effect is generally advantageous also with the optical collecting element.

If the optical collecting element is not a diffractive element, but instead is a lens with a positive refractive power, then this lens is preferably biconvex. In the case of an aspherical effect the curvature of the biconvex lens may be least at the axis of symmetry of the collecting lens.

In order to achieve an even better intermixing, a scattering device may be provided, which scatters the light generated by the light sources. The scattering device may for example be a diffusing screen with an irregularly shaped or specially structured surface. In the latter case the typical structure size should not exceed 1 mm and preferably not exceed 0.1 mm. Instead of an additional diffusing screen such a surface may also be provided on any existing optical components, for example on a plane or curved surface of the collecting lens.

Particularly suitable as light sources are LEDs, since these semiconductor elements have a very high light yield. Also, LEDs are so small that they can also be arranged within the fitting housing in the immediate vicinity of the water inlet or water outlet.

Furthermore, it is preferred if the light sources generates light in the colours red, green and blue. Particularly pleasing colours can be generated if in addition a light source is also provided that generates yellow light.

In order to increase the luminance (illumination density), several sets of light sources may also be provided, each set containing light sources for all desired colours. These sets of light sources may also be designed as so-called multi-colour LEDs, in which several light sources are assembled in the form of light-emitting elements in a housing. In this way a colour mixing is already achieved within an individual multi-colour LED.

These and other objects and advantages will be made apparent from the following brief description of the drawings and the detailed description of the invention.

DETAILED DESCRIPTION OF THE PRESENT INVENTION

Figure 1:
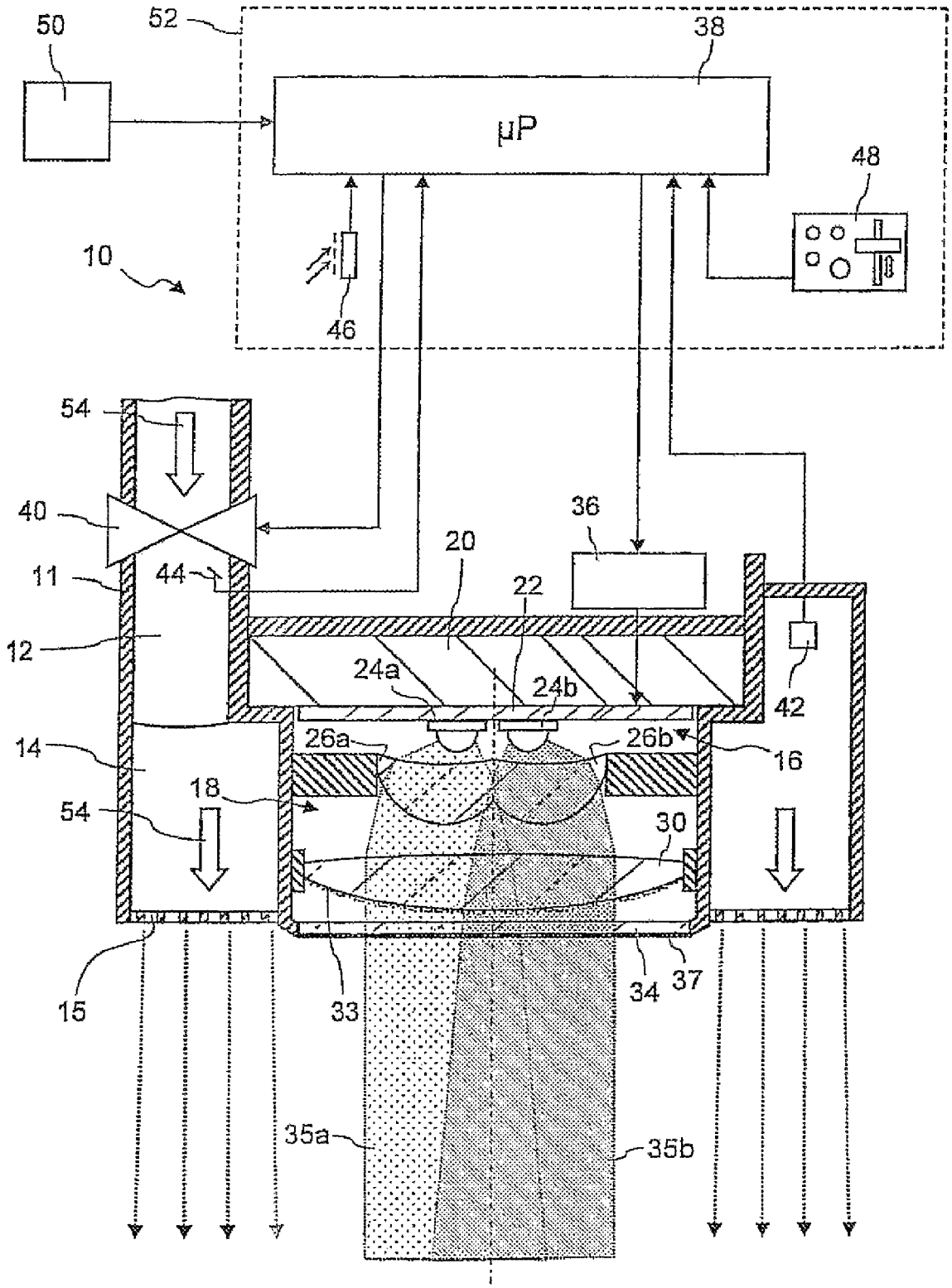
FIG. 1 is a diagrammatic axial section of an outflow head of a sanitary fitting comprising a collecting optics.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

FIG. 1 shows in a diagrammatic axial section an outlet head 10 of a sanitary fitting, which is firmly installed in the sanitary area or may also be part of a handpiece. The sanitary fitting may for example be a shower fitting, a washstand fitting or a bath fitting. The outflow head 10 has a housing 11 and a mixing water outflow 12 contained therein, which is connected in a manner known per se to a mixer unit (not shown in FIG. 1). The mixer unit is for its part connected to a hot water source and a cold water source. The mixing water outflow 12 transforms into an annular duct 14, which is provided on the front side with outlet openings 15.

A light source arrangement 16 and a collecting optics 18 are accommodated in the space enclosed by the annular duct 14. The light source arrangement 16 includes a plate 22 carrying three LEDs 24*a*, 24*b*, 24*c*, which is mounted on a heat sink 20, in which connection only the two LEDs 24*a*, 24*b* can be seen in the sectional representation of FIG. 1. The LEDs 24*a*, 24*b*, 24*c* are designed to generate red, green and blue light.

The structure of the collecting optics 18 is described in more detail hereinafter with reference to FIGS. 2 and 3, which show the collecting optics 18 in a mid-sectional view and in a horizontal section along the line III-III.

The LEDs 24*a*, 24*b*, 24*c* are arranged with three-fold symmetry on a first circle K, which is concentric to a common optical axis GOA of the collecting optics 18. The LEDs 24*a*, 24*b*, 24*c* have mutually parallel radiation axes 25*a*, 25*b*, 25*c*, which lie on the first circle K and form the axes of symmetry of the radiated light cones.

Three lens elements 26*a*, 26*b*, 26*c*, abut or are bonded to one another along planar surfaces P, are located in the light propagation direction immediately behind the LEDs 24*a*, 24*b*, 24*c*. The three lens elements 26*a*, 26*b*, 26*c* form a common lens body in this way.

Each of the lens elements 26*a*, 26*b*, 26*c* has an axis of symmetry 27*a*, 27*b*, 27*c*, with respect to which the entry surfaces 28*a*, 28*b*, 28*c* as well as the exit surfaces 29*a*, 29*b*, 29*c* are symmetrically aligned. The axes of symmetry 27*a*, 27*b*, 27*c* run parallel to one another and intersect a second circle K'r which is concentric to the first circle R about the joint axis of symmetry GOA.

The entry surfaces 28*a*, 28*b*, 28*c* as well as the exit surfaces 29*a*, 29*b*, 29*c* are shaped aspherically, the curvature increasing in each case with increasing radial distance from the axes of symmetry 27*a*, 27*b*, 27*c*.

The axes of symmetry 27*a*, 27*b*, 27*c* are arranged staggered by a distance d relative to the radiation axes 25*a*, 25*b*, 25*c* of the LEDs 24*a*, 24*b*, 24*c*. As can be seen particularly well in FIG. 3, this staggering d corresponds to the difference between the radii of the circles K and K' on which lie the radiation axes 25*a*, 25*b*, 25*c* and the axes of symmetry 27*a*, 27*b*, 27*c*.

In the light propagation direction a biconvex collecting lens 30 is arranged behind the lens elements 26*a*, 26*b*, 26*c*, the axis of symmetry of the lens coinciding with the common optical axis GOA. The collecting lens 30 also has an aspherical entry surface 31 and an aspherical exit surface 32, the curvatures of which increase with increasing distance from the common optical axis GOA. The exit surface 32 has been made matt or profiled by removal of material, e.g. by etching, sanding, grinding or milling, in order to produce diffusing structures 33. The purposes of the diffusing structures 33 is to intermix further the light beams generated by the LEDs 24*a*, 24*b*, 24*c*. Instead of the diffusing structures 33, an additional diffusing screen with an etched, sanded or ground surface may also be used. A stronger scattering is obtained with volume diffusing discs, such as are used for example as milk glass discs.

Figure 2:
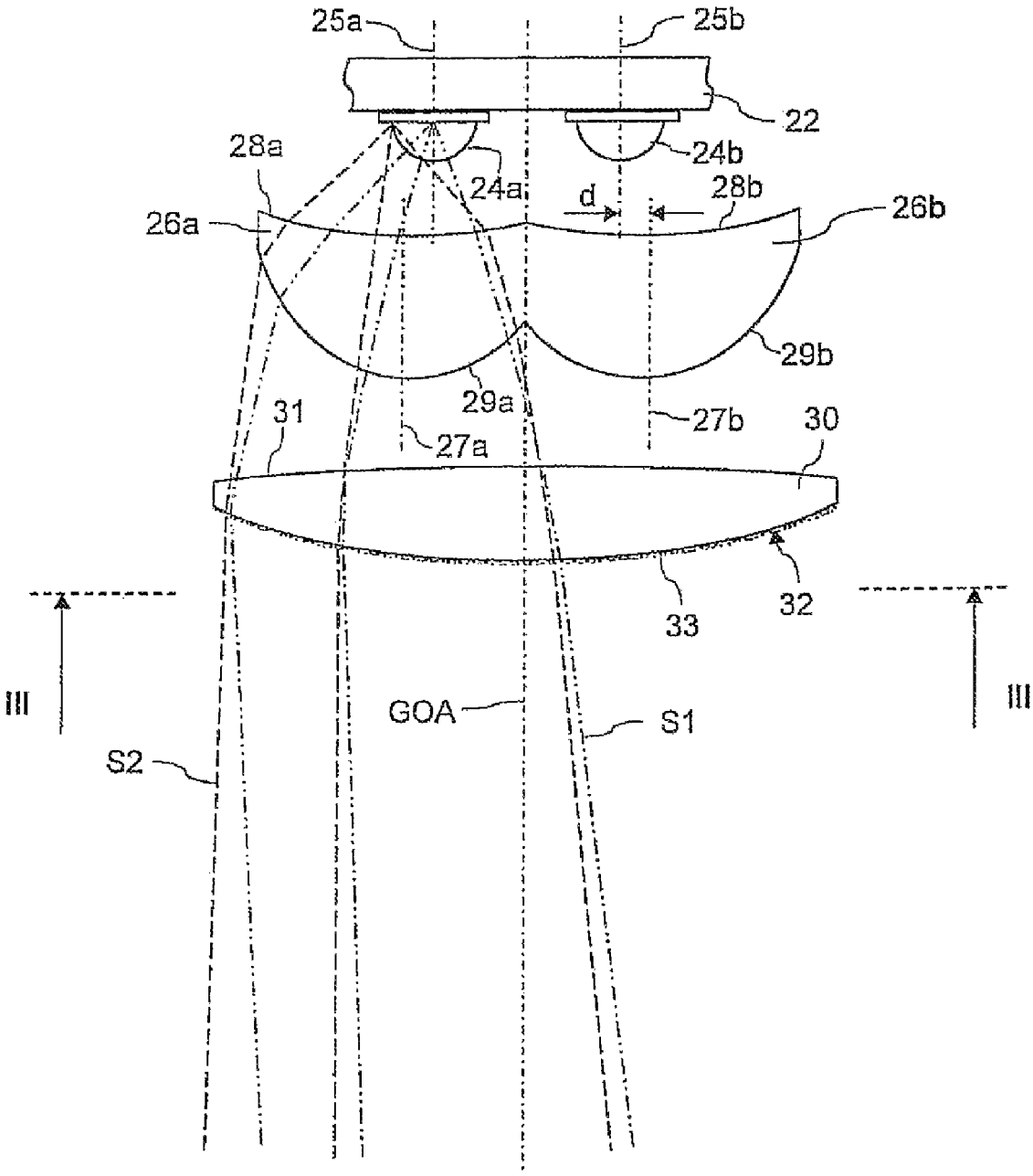
FIG. 2 is a mid-section through the collecting optics of FIG. 1.
Figure 3:
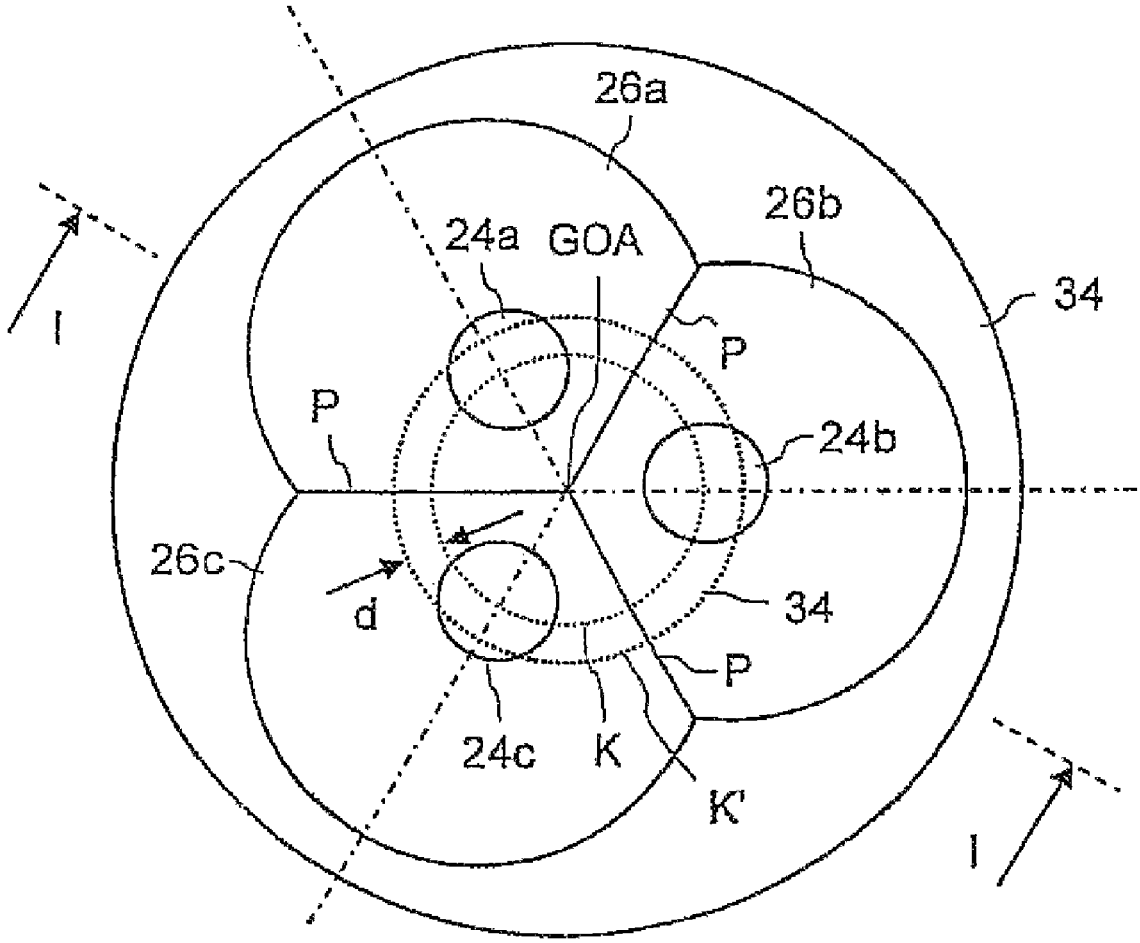
FIG. 3 is a horizontal section through the collecting optics along the line III-III.

In order to illustrate the light ray path, two light beams S1, S2 with their marginal rays and their main ray are illustrated in FIG. 2 for the LED 24*a*. The light beam S1 which is denoted by chain-dotted lines, is an axial field beam, while the light beam S2 denoted by the dotted lines starts from a marginal point of the LED 24*a*.

As can be seen from FIG. 2, the light generated by the LED 24*a* is collected by the lens element 26*a* and, tilted as a whole relative to the common optical axis GOA, is directed onto the collecting lens 30. The tilting is produced by the staggered relationship between the radiation axes 25*a*, 25*b*, 25*c* on the one hand and the axes of symmetry 27*a*, 27*b*, 27*c* of the lens elements 26*a*, 26*b*, 26*c* on the other hand. On account of the tilting the light beams generated by the LEDs 24*a*, 24*b*, 24*c* are superimposed on one another, which can be recognised particularly easily in the diagrammatic representation of FIG. 1. The collecting optics 18 is in this connection designed so that a complete super positioning of the three light beams occurs at a distance of about 50 cm from the LEDs 24*a*, 24*b*, 24*c*. The intermixing of the coloured beams generated by the LEDs 24*a*, 24*b*, 24*c* is most effective at this distance.

Prior to and following this the intermixing occurs only in a central region, which is surrounded by monochromatic light. The colour of this monochromatic light varies on moving around the common light beam. As a result of the spatially close arrangement of the LEDs 24*a*, 24*b*, 24*c* on the one hand and the relatively distantly located plane of the complete intermixing on the other hand, the proportion of monochromatic light is however relatively small, so that the light leaving the outflow head 10 produces overall an extremely homogeneous colour impression in a user of the sanitary fitting. By using more powerfully scattering diffusing structures 33 the intermixing can be increased further, though at the cost of a loss of focussing.

With the light beams 35*a*, 35*b* generated by the LEDs 24*a* and 24*b* respectively and which are indicated by dotted surfaces in FIG. 1, it is assumed that the light generated by the LEDs 24*a*, 24*b* passes through the respective associated lens element 26*a* and 26*b*. A relatively small portion of the light may however in certain circumstances pass through a lens element that is associated with a different LED. This light exits from the outflow head 10 at relatively large angles with respect to the common optical axis GOA. Insofar as such an angular light emission is undesired, this relatively small portion of the light can be prevented by means of a suitable dimming directly at the LEDs 24*a*, 24*b*, 24*c*, from striking a lens element that is not associated with the respective LED per se.

At the light exit side the collecting optics 18 is occluded by a cover disc 34, which is detachably secured to the housing 11 of the outflow head 10. The cover disc 34 is provided on the outside with a coating 37 that helps to prevent the deposition of limescale. The cover disc 34 can accordingly be cleaned very easily by wiping with a damp cloth.

The plate 22 of the light source arrangement 16 is connected via a power electronics unit 36 to a control device 38 of the outflow head 10. The purpose of the control device 38 is to control individually the LEDs 24*a*, 24*b*, 24*c*. Also, the control device 38 acts on a magnetic valve 40 incorporated in the mixing water outflow 12, by means of which the amount of outflowing mixing water can be adjusted.

In addition the control device 38 is connected to a temperature sensor 42 and a flow switch 44, which generates a switching signal as soon as mixing water flows from the mixing water outflow 12 into the annular duct 14. The control device 38 can determine via a photodetector 46 the brightness in a room in which the outflow head 10 is situated. The function of the outflow head 10 can be controlled and if necessary also programmed via an operating unit 48. For the power supply the control device 38 is connected to a voltage source 50, which may for example be the domestic alternating current network or a battery. The control device 38, in which the power electronics unit 36 can be integrated, the photodetector 46 and the operating unit 48 may be arranged spatially remote from the other parts of the outflow head 10, which is indicated by a dotted line 52. Such a spatial separation is convenient for example if the outflow head 10 together with a handpiece forms a shower head.

The outflow head 10 described hereinbefore with the aid of FIGS. 1 to 3 functions as follows:

When a user adjusts the desired amount of water and temperature using the operating unit 48, the magnetic valve 40 discharges the corresponding amount of water at the desired temperature prepared by the mixer unit (not shown). The mixing water, which flows through the magnetic valve 40 in the flow direction indicated by the arrow 54, actuates the throughflow switch 44. The control device 38 thereby receives the information that water is now flowing from the outlet openings 15 of the outflow head 10.

In a first operating mode, which can be adjusted at the operating unit 48, the control device 38 controls the LEDs 24*a*, 24*b*, 24*c* so that the light generated by the LEDs 24*a*, 24*b*, 24*c* has a colour correlated to the water temperature. The actual water temperature is at the same time transmitted by the temperature sensor 42 to the control device 38. The colour may for example be chosen so that blue light is generated in the case of cold water, red light in the case of hot water and white light in the case of lukewarm water. The light of the desired colour is in this connection generated by additive mixing of the light generated by the LEDs 24*a*, 24*b*, 24*c*.

With the aid of the photodetector 46 the control device 38 can determine how bright the ambient light is. The brighter the ambient light, the higher must be the intensity of the light generated by the LEDs 24*a*, 24*b*, 24*c*. Only then is it ensured that the light generated by the light source arrangement 16 is discernable by the user.

The LEDs 24*a*, 24*b*, 24*c* also only generate light when the throughflow switch 44 records a flow of water in the water outflow 12. This prevents light being generated before water has flowed out of the outlet openings 15 and thereby prevents interfering glare phenomena for the user.

The mixed colour beam generated by the light source arrangement 16 is cylindrically surrounded by the outflowing mixing water and thus illuminates the mixing water internally.

The heat loss from the LEDs 24*a*, 24*b*, 24*c* is conducted via the plate 22 to the heat sink 20, which is in direct thermal contact with the housing 11 of the outflow head 10. The heat loss can be dissipated in this way via the heat sink 20 to the mixing water flowing through the outflow head 10.

In a second operating mode, which can be adjusted at the operating unit 48, the user can adjust a colour for the light generated by the LEDS 24*a*, 24*b*, 24*c*, independently of the water temperature. The choice of this colour can be determined according to various aspects. The colour can for example be adjusted directly at the operating unit 48 via corresponding operating elements. It is also possible for the colour to be stored in a transponder card, which can cooperate with a transmitter/receiver head in the operating unit 48. The colour stored on the transponder card may for example be freely chosen by the user or predetermined by a light therapist. In addition or alternatively, the colour may also be chosen depending on the time of day, the season, or the weather.

It is again emphasized that the above-described embodiments of the present invention, particularly, any "preferred" embodiments, are possible examples of implementations merely set forth for a clear understanding of the principles of the invention. Many variations and modifications may be made to the above-described embodiments of the invention without substantially departing from the spirit and principles of the invention. All such modifications are intended to be included herein within the spirit of the invention and the scope of protection is only limited by the accompanying claims.

The invention claimed is:

1. A sanitary fitting including an assembly of several light sources for illuminating water that flows out of or into the sanitary fitting, whereby light of different colours can be generated by the said light sources, the sanitary fitting comprising a collecting optics arranged in front of the light sources, for focusing and mixing the light generated by the light sources, wherein the collecting optics comprises a plurality of optical elements having a collecting action, in which at least one of the optical elements is reversibly uniquely associated with each light source, and further wherein the focusing as well as the mixing of the light generated by the light sources are provided by the optical elements;

wherein the light sources generate light beams that are at least substantially rotationally symmetrical with respect to a radiation axis associated with the respective light source;

wherein the radiation axes of the light sources run parallel to one another; and wherein at least one light source is arranged in such a way with respect to the optical element associated with it that the radiation axis of the at least one light source runs parallel and staggered by a distance (d) with respect to the axis of symmetry of the associated optical element.

2. The sanitary fitting of claim 1, wherein the optical elements have axes of symmetry that run parallel to one another.

3. The sanitary fitting of claim 1, wherein the staggered distance (d) is more than 10% of the radius of the respective optical element.

4. The sanitary fitting of claim 1, wherein the optical elements have the effect of an aspherical lens.

5. The sanitary fitting of claim 1, wherein the optical elements are diffractive optical elements.

6. The sanitary fitting of claim 1, wherein the optical elements are lens elements.

7. The sanitary fitting of claim 6, wherein the lens elements have in each case a concave entry surface and a convex exit surface.

8. The sanitary fitting of claim 7, wherein the concave entry surface has a curvature that is least on the axis of symmetry.

9. The sanitary fitting of claim 6, wherein the lens elements form a one-piece unit.

10. The sanitary fitting of claim 1, wherein the collecting optics includes an optical collecting element having a collecting action, which collects jointly the light beams leaving the optical elements.

11. The sanitary fitting of claim 10, wherein the optical collecting element has the effect of an aspherical lens.

12. The sanitary fitting of claim 10, wherein the optical collecting element is a collecting lens.

13. The sanitary fitting of claim 12, wherein the collecting lens is biconvex.

14. The sanitary fitting of claim 12, wherein the collecting lens has a convex exit surface, the curvature of which is least at the axis of symmetry (GOA) of the collecting lens.

15. The sanitary fitting of claim 1, wherein the light sources are arranged distributed with a multi-fold symmetry around a common axis of symmetry (GOA).

16. The sanitary fitting of claim 15, wherein the light sources are arranged distributed with a multi-fold symmetry around a common axis of symmetry (GOA) and the optical elements adjoin one another along the common axis of symmetry (GOA) of the light sources.

17. The sanitary fitting of claim 15, wherein the light sources are arranged distributed with a multi-fold symmetry around a common axis of symmetry (GOA) and the optical collecting element has an axis of symmetry that runs along the common axis of symmetry (GOA) of the light sources.

18. The sanitary fitting of claim 1, further comprising a diffusing device that scatters the light generated by the light sources.

19. The sanitary fitting of claim 18, wherein the diffusing device includes a surface with structures, the dimensions of which are less than 1 mm.

20. The sanitary fitting of claim 19, wherein the surface is an optically active surface of the collecting lens.

21. The sanitary fitting of claim 1, wherein the light sources are LEDs.

22. The sanitary fitting of claim 1, wherein the light sources generate light in the colours red, green, and blue.

23. The sanitary fitting of claim 22, wherein the colour red is defined by light wavelengths between 625 nm and 650 nm, the colour green is defined by light wavelengths between 500 nm and 550 nm, and the colour blue is defined by light wavelengths between 455 nm and 485 nm.

24. The sanitary fitting of claim 1, further comprising a light source which generates light of the colour yellow.

25. The sanitary fitting of claim 24, wherein the colour yellow is defined by light wavelengths between 570 nm and 590 nm.

26. The sanitary fitting of claim 1, wherein the light generated by the light sources is propagated without an optical guide in the sanitary fitting.

27. The sanitary fitting of claim 1, wherein the sanitary fitting has inlet openings or outlet openings for water, which surround the arrangement of the light sources.

* * * * *